US005209857A

United States Patent [19]

Kenyon et al.

[11] Patent Number: 5,209,857

[45] Date of Patent: May 11, 1993

[54] FABRIC SOFTENING DETERGENT COMPOSITIONS CONTAINING SMECTITE CLAYS HAVING A LATTICE CHARGE DEFICIENCY

[75] Inventors: Ian R. Kenyon, Gayton; Robin S. Heslam, Wallasey; William D. Emery, Bromborough; Hermes J. Murakami, Port Sunlight, all of Great Britain

[73] Assignee: Lever Brothers Company, Division of Conopco, Inc., New York, N.Y.

[21] Appl. No.: 373,761

[22] Filed: Jun. 29, 1989

[30] Foreign Application Priority Data

Jul. 6, 1988 [GB] United Kingdom ..... 8816112

[51] Int. Cl.[5] ..... C11D 3/12

[52] U.S. Cl. ..... 252/8.6; 252/174.25; 252/140

[58] Field of Search ..... 252/8.6, 140, 174.25

[56] References Cited

U.S. PATENT DOCUMENTS

| | | | |
|---|---|---|---|
| 4,071,463 | 1/1978 | Steinhauer | 252/103 |
| 4,287,079 | 9/1981 | Robinson | 252/99 |
| 4,397,755 | 8/1983 | Brierley | 252/113 |
| 4,582,615 | 4/1986 | Ramachandran et al. | 252/8.6 |
| 4,597,886 | 7/1986 | Goedhart | 252/95 |
| 4,655,794 | 4/1987 | Richardson | 51/293 |
| 4,770,815 | 9/1988 | Baker et al. | 252/542 |
| 4,861,502 | 8/1989 | Caswell | 252/8.75 |
| 4,885,101 | 12/1989 | Tai | 252/8.6 |
| 5,019,292 | 5/1991 | Baeck et al. | 252/174.25 |

FOREIGN PATENT DOCUMENTS

| | | |
|---|---|---|
| 0213730 | 3/1987 | European Pat. Off. . |
| 0297673 | 1/1989 | European Pat. Off. . |
| 1400898 | 7/1975 | United Kingdom . |
| 1518529 | 7/1978 | United Kingdom . |

*Primary Examiner*—Paul Lieberman
*Assistant Examiner*—Bradley A. Swope
*Attorney, Agent, or Firm*—A. Kate Huffman

[57] ABSTRACT

A detergent composition for washing and softening fabrics comprising at least one detergent active material and, as a fabric softening agent, a smectite clay mineral which is a 2:1 layer phyllosilicate possessing a lattice charge deficiency in the range of 0.2 to 0.4 g equivalents per half unit cell.

4 Claims, No Drawings

FABRIC SOFTENING DETERGENT COMPOSITIONS CONTAINING SMECTITE CLAYS HAVING A LATTICE CHARGE DEFICIENCY

This invention relates to detergent compositions, in particular to detergent compositions for washing fabrics and providing said fabrics with a softening benefit.

It is common practice to wash fabrics in detergent compositions which contain a detergent active material for removing soil from the fabrics. With some fabrics, especially of natural origin, repeated washing can lead to fabric harshness, giving the fabrics an unpleasant feel. For some years fabric conditioning products have been available, intended inter alia for alleviating this fabric harshness by softening the fabrics in a post-washing step, eg. in the rinse step of a fabric laundering process. There has been a desire to provide a single detergent composition which would be capable of both washing and softening the fabrics to overcome the inconvenience of using separate products. According to British Patent Specification GB1400898 (Procter & Gamble) a possible solution to this problem is to include in the detergent composition a three-layer smectite clay containing material having a cation exchange capacity of at least 50 meq/100 g, together with an anionic or similar detergent active material.

While some success has been obtained with the use of such clay materials, softening performance still does not generally match that obtained by the use of separate products and there is therefore still some scope for further improving performance.

We have now discovered a specific class of clay materials which are capable of generating softening benefits better than those obtained by the use of the clays disclosed in the above mentioned art.

Thus according to the invention there is provided a detergent composition for washing and softening fabrics comprising at least one detergent active material and, as a fabric softening agent, a smectite clay mineral which is a 2:1 layer phyllosilicate possessing a lattice charge deficiency in the range of 0.2 to 0.4 g equivs. per half unit cell.

The smectite clays taught in the art are 2:1 layer phyllosilicates characterised by possessing a lattice charge deficiency in the range of 0.2 to 0.6 g equivs. per half unit cell, which results in an exchange capacity of say 60 to 150 meq per 100 g of mineral. We have now found that certain clays give better softening performance than others and that the common feature of these materials is that they contain smectite minerals in which the lattice charge deficiency is at the lower end of the range, ie. from 0.2 to 0.4 g equivs. per half unit cell.

In general, clays which are useful in the present invention fall into the formula:

$$(Si_{4-y}Al_y)(Al_{2-a-b}M^{III}_aN^{II}_b)O_{10}(OH)_2X^I_{y+b}$$

in which $M^{III}$ is a trivalent metal ion most commonly being selected from iron, chromium, manganese and mixtures thereof, $N^{II}$ is a divalent metal ion most commonly being selected from magnesium, iron and mixtures thereof, y is zero or a positive number less than 4, a and b are positive numbers less than 2 such that y+b is from 0.2 to 0.4 and $X^I$ is a balancing exchangeable cation which can be a univalent inorganic or organic ion or the equivalent amount of a divalent ion, $X^I$ being most commonly selected from Na, K, ½Ca, ½Mg and mixtures thereof.

Such clays are commercially available but have not previously been proposed for use in detergent compositions. Clays that have been proposed include those available under the trade name GELWHITE from Texas, U.S.A. and LAVIOSA AGB from Italy but such clays have been found to have a lattice deficiency (y+b) of about 0.54 and in the range 0.46 to 0.55 respectively. Clays useful in the present invention have been found in Wyoming U.S.A., but not all Wyoming clays are suitable. Thus British patent GB1518529 (Procter & Gamble/Baskerville) discloses a Wyoming bentonite VOLCLAY BC, which has a very high ion exchange capacity (ie. has a high lattice deficiency) and U.S. Pat. No. 4582615 (Ramachandran) discloses the use of General Purpose Bentonite from American Colloid Company also believed to be a Wyoming bentonite. From the analytical data published in U.S. Pat. No. 4582615, the best estimate of structure which can be derived leads one to believe that its lattice deficiency is about 0.42.

Clays useful in the present invention include the following:.

| Trade Name | Origin | M | N | y | a | b |
|---|---|---|---|---|---|---|
| VOLCLAY SPV | USA | Fe | Fe/Mg | 0.01 | 0.06 | 0.37 |
| SURREY NO. 1 EARTH | UK | Fe | Mg | 0 | 0.41 | 0.32 |
| ENVIRONETICS | Argentina | Fe | Mg | 0 | 0.12 | 0.33 |
| CULVIN | South Africa | Fe | Mg | 0.11 | 0.23 | 0.28 |
| SAN FRAN | Argentina | Fe | Fe/Mg | 0.07 | 0.15 | 0.21 |
| BERKBOND 1 | UK | Fe | Mg | 0.04 | 0.58 | 0.31 |
| STEETLEY WYOMING | USA | Fe | Mg | 0 | 0.28 | 0.32 |

These clays are naturally of both sodium and calcium types ($X^I$=Na or ½ Ca), and we have found that the nature of the substituent $X^I$ is irrelevant to softening performance from a detergent composition.

The following clays are not however useful in the present invention:

| Trade Name | Origin | M | N | y | a | b |
|---|---|---|---|---|---|---|
| MDO 77/84 ECC (ASB) | Morocco | Fe | Mg | 0.26 | 0.12 | 0.23 |
| UBM | Brazil | Fe | Mg | 0.20 | 0.06 | 0.38 |
| CSM (high CEC Prassa) | Greece | Fe | Mg | 0.05 | 0.08 | 0.42 |
| STEETLEY | Turkey | Fe | Mg | 0.01 | 0.06 | 0.60 |
| LAPORTE | Spain | Fe | Mg | 0.14 | 0.08 | 0.44 |
| GELWHITE | Texas USA | Fe | Mg | 0.17 | 0.05 | 0.37 |
| WILLEMSE | S. Africa | Fe | Mg | 0.33 | 0.40 | 0.28 |

The reason for the improved softening benefits obtained with the selected clays is not fully understood. While not wishing to be bound by theory one may suppose that differences in lattice charge affect the strength of repulsion forces between the clay and the fabric enabling a higher level of clay to be maintained on the fabric surface even over multiple washes.

The compositions according to the invention may take various physical forms and may contain a variety of additional ingredients.

An essential ingredient is a detergent active material. This may be selected from anionic, nonionic, amphoteric, zwitterionic and cationic materials, with a special preference for synthetic anionic surfactants, with or without nonionic surfactants.

Particularly preferred are mixtures of anionic and nonionic detergent active materials such as a mixture of an alkalimetal salt of an alkyl benzene sulphonate or a branched alkyl benzene sulphonate together with an alkoxylated alcohol. The level of detergent active material or materials in the composition may be from 2% to 50%, most preferably from 5% to 30% by weight.

The preferred detergent compounds which can be used are synthetic anionic and nonionic compounds. The former are usually water-soluble alkali metal salts of organic sulphates and sulphonates having alkyl radicals containing from about 8 to about 22 carbon atoms, the term alkyl being used to include the alkyl portion of higher acyl radicals. Examples of suitable synthetic anionic detergent compounds are sodium and potassium alkyl sulphates, especially those obtained by sulphating higher ($C_8$–$C_{18}$) alcohols produced for example from tallow or coconut oil, sodium and potassium alkyl ($C_9$–$C_{20}$) benzene sulphonates, particularly sodium linear secondary alkyl ($C_{10}$–$C_{15}$) benzene sulphonates; sodium alkyl glyceryl ether sulphates, especially those ethers of the higher alcohols derived from tallow or conconut oil and synthetic alcohols derived from petroleum; sodium coconut oil fatty monoglyceride sulphates and sulphonates; fatty acid ester sulphonates and fatty amide sulphonates; sodium and potassium salts of sulphuric acid esters of higher ($C_8$–$C_{18}$) fatty alcohol-alkylene oxide, particularly ethylene oxide, reaction products; the reaction products of fatty acids such as coconut fatty acids esterified with isethionic acid and neutralised with sodium hydroxide; sodium and potassium salts of fatty acid amides of methyl taurine; alkane monosulphonates such as those derived by reacting alpha-olefins ($C_8$–$C_{20}$) with sodium bisulphite and those derived from reacting paraffins with $SO_2$ and $Cl_2$ and then hydrolysing with a base to produce a random sulphonate; and olefin sulphonates, which term is used to describe the material made by reacting olefins, particularly $C_{10}$–$C_{20}$ alpha-olefins, with $SO_3$ and then neutralising and hydrolysing the reaction product. The preferred anionic detergent compounds are sodium ($C_{11}$–$C_{15}$) alkyl benzene sulphonates and sodium ($C_{16}$–$C_{18}$) alkyl sulphates.

Suitable nonionic detergent compounds which may be used include in particular the reaction products of compounds having a hydrophobic group and a reactive hydrogen atom, for example aliphatic alcohols, acids, amides or alkyl phenols with alkylene oxides, especially ethylene oxide either alone or with propylene oxide. Specific nonionic detergent compounds are alkyl ($C_6$–$C_{22}$) phenols-ethylene oxide condensates, generally up to 25 EO, ie. up to 25 units of ethylene oxide per molecule, the condensation products of aliphatic ($C_8$–$C_{18}$) primary or secondary linear or branched alcohols with ethylene oxide, generally up to 40 EO, and products made by condensation of ethylene oxide with the reaction products of propylene oxide and ethylenediamine. Other so-called nonionic detergent compounds include long chain tertiary amine oxides, long chain tertiary phosphine oxides and dialkyl sulphoxides.

Mixtures of detergent compounds, for example mixed anionic or mixed anionic and nonionic compounds may be used in the detergent compositions, particularly in the latter case to provide controlled low sudsing properties. This is beneficial for compositions intended for use in suds-intolerant automatic washing machines.

Amounts of amphoteric or zwitterionic detergent compounds can also be used in the compositions of the invention but this is not normally desired due to their relatively high cost. If any amphoteric or zwitterionic detergent compounds are used it is generally in small amounts in compositions based on the much more commonly used synthetic anionic and/or nonionic detergent compounds.

A detergency builder may also be present. This may be any material capable of reducing the level of free calcium ions in the wash liquor and will preferably provide the composition with other beneficial properties such as the generation of an alkaline pH, the suspension of soil removed from the fabric and the suspension of the fabric softening clay material. The level of the detergency builder may be from 10% to 70% by weight, most preferably from 25% to 50% by weight.

Examples of detergency builders include precipitating builders such as the alkali metal carbonates (with or without seed crystals such as calcite), bicarbonates, ortho phosphates, pyro phosphates, sequestering builders such as the alkali metal tripolyphosphates or nitrilotriacetates, or ion-exchange builders such as the amorphous alkalimetal aluminosilicates or the zeolites.

The clay material can be added in various physical forms. It may, for example, be spray-dried with other components of the formulation or it may be added separately. In the latter case the clay may be ground to a suitable size, say 150 to 2000 microns, or may be in the form of granulated fine particles optionally containing a binder such as an inorganic salt or a surfactant. Especially suitable binders are sodium silicate and nonionic detergent active materials. When dry mixed clays are utilised any poor colour (often due to trace amounts of certain transition metal ions in the structure) may be disguised by granulating or coating with a white or more acceptably coloured pigment material.

The level of the fabric softening clay material in the composition should be sufficient to provide a softening benefit, such as from 1.5% to 35% by weight, most preferably from 4% to 15% by weight, calculated on the basis of the clay mineral per se.

In addition to the detergent active material, the detergency builder and the clay containing material, the compositions according to the invention optionally contain other ingredients.

Apart from the components already mentioned, a detergent composition of the invention can contain any of the conventional additives in the amounts in which such additives are normally employed in fabric washing detergent compositions. Examples of these additives include the lather boosters such as alkanolamides, particularly the monoethanolamides derived from palm kernel fatty acids and coconut fatty acids, lather depressants, oxygen-releasing bleaching agents such as sodium perborate and sodium percarbonate, peracid bleach precursors, chlorine-releasing bleaching agents such as triclorisocyanuric acid, inorganic salt such as sodium sulphate, other fillers such as kaolin, and, usually present in very minor amounts, fluorescent agents, perfumes, other enzymes such as proteases and amylases, germicides and colourants.

The invention will now be described in more detail with reference to the following non-limiting examples.

EXAMPLE 1

A detergent composition was prepared having the following formulation:

| Ingredient | Parts by weight |
|---|---|
| Alkyl benzene sulphonate | 9.0 |
| Alcohol ethoxylate (7EO) | 1.0 |
| Alcohol ethoxylate (3EO) | 3.0 |
| Sodium tripolyphosphate | 21.5 |
| Sodium silicate | 5.5 |
| Burkeite | 9.0 |
| Water and miscellaneous | 12.7 |
| | 61.7 |

Washing experiments were carried out by adding 3.085 g/l of this composition to water in a laboratory scale (Tergotometer - Trade Mark) apparatus together with 0.5g/l of clay or no clay as detailed below.

Cotton fabric test pieces were washed, rinsed and dried for six cycles. In the first three cycles the clay was included, in the next two it was omitted and in the final cycle it was included again. After each cycle the amount of clay retained by the fabric was determined using an ashing technique.

Two different clays were used. Clay S was SURREY NO. 1 EARTH and Clay M was MDO 77/84, details of which are given above. The results obtained were as follows (% clay on fabric):

| Cycle | Clay S | Clay M |
|---|---|---|
| 1 | 0.32 | 0.29 |
| 2 | 0.55 | 0.45 |
| 3 | 0.66 | 0.44 |
| 4 | 0.56 | 0.32 |
| 5 | 0.56 | 0.25 |
| 6 | 0.67 | 0.36 |

It is clear from these results that deposition is greater with Clay S, an apparent stable equilibrium being achieved at approximately 0.56% on the fabric and with an additional reversibly attached level of approximately 0.10%. With Clay M no stable equilibrium resistant to removal is reached.

The softness of the treated fabrics after 6 cycles were compared with one another and with the untreated fabrics with the following results:

| Comparison | % Preference |
|---|---|
| Clay S v Clay M | 69:31 |
| Clay S v Untreated | 100:0 |
| Clay M v Untreated | 100:0 |

While both clays provide a benefit which is preferred over no treatment, Clay S shows a clear preference over Clay M.

EXAMPLE 2

In these examples a commercially available fabric washing composition was used, having the following approximate composition:

| Ingredient | % by weight |
|---|---|
| Alkyl benzene sulphonate | 16.0 |
| Sodium tripolyphosphate | 11.0 |
| Sodium silicate | 9.0 |
| Sodium sulphate | 16.5 |
| Sodium carbonate | 20.0 |
| Kaolin | 14.0 |
| Water and minor ingredients | balance |

A fabric load comprising a mixture of cotton and polycotton fabrics was washed in water having a hardness of 6° FH ($6\times10^{-4}$ molar free calcium ions) using the above composition at a dosage level of 2.5 g/l. The liquor to cloth ratio was 10:1 by weight. The fabrics were soaked for 30 minutes followed by a hand wash and two rinses.

In Examples 2 and 2B, the kaolin was replaced by the same amount of, respectively, VOLCLAY SPV (lattice deficiency 0.37) and UBM (lattice deficiency 0.58) and in Example 2C the above composition was used as such.

After washing, cotton pieces from the wash load were compared for softness against standards and given a panel score on a scale ranging from 2 (soft) to 14 (very harsh. The results were:

| Example No. | Clay | Panel score |
|---|---|---|
| 2 | VOLCLAY | 10.3 |
| 2B | UBM | 12.6 |
| 2C | — | 12.3 |
| 95% CL | | ±0.5 |

The results shows that both the unmodified product and the product containing the UBM clay gave relatively harsh results whereas the product containing VOLCLAY clay gave significantly superior results.

EXAMPLE 3

Example 2 was repeated with the following differences. The product used had the following composition:

| Ingredient | % by weight |
|---|---|
| Alkyl benzene sulphonate | 28.0 |
| Sodium tripolyphosphate | 25.0 |
| Sodium silicate | 7.0 |
| Sodium sulphate | 22.5 |
| Sodium carbonate | 10.0 |
| Water and minor ingredients | balance |

Wash conditions were the same as in Example 2 aexcept that the water hardness was 20° FH and the product dosage was 7.0 g/l.

The clays were used to replace 14% of the sodium sulphate in the composition. In Examples 3 and 3A, the clay used was, respectively, VOLCLAY SPV and CULVIN (lattice deficiency 0.39) in comparative Example 3B the clay was ECC/ASB (lattice deficiency 0.49) and in Example 3C the above composition was used as such.

The results were:

| Example No. | Clay | Panel score |
|---|---|---|
| 3 | VOLCLAY | 8.2 |
| 3A | CULVIN | 8.2 |
| 3B | EEC | 10.4 |
| 3C | — | 10.4 |
| 95% CL | | ±0.5 |

These results again show that the compositions according to the invention (Examples 3 and 3A) provide a significant benefit over compositions containing alternative clays or over no treatment.

We claim:

1. A detergent composition for washing and softening fabrics consisting essentially of from 2% to 50% by weight of at least one detergent active material and, as a fabric softening agent, a semctite clay mineral which is a 2:1 layer phyllosilicate possessing a lattice charge deficiency in the range of 0.2 to 0.4 g equivs. per half unit cell, and which falls into the formula:

$$(Si_{4-y}Al_y)\,(Al_{2-a-b}M^{III}_aN^{II}_b)O_{10}(OH)_2X^I_{y+b}$$

in which $M^{III}$ is a trivalent metal ion, $N^{II}$ is a divalent metal ion, $X^I$ is a balancing exchangeable cation, y is O or a positive number less than 4, and a and b are positive numbers less than 2 such that y+b is from 0.2 to 0.4.

2. A composition according to claim 1 wherein the composition further comprises from 10% to 70% by weight of a detergency builder.

3. A composition according to claim 1 which comprises from 1.5 to 35% by weight of the smectite clay mineral.

4. A composition according to claim 1 which is a granular composition.

* * * * *